United States Patent [19]

Gilbert

[11] 4,105,078

[45] Aug. 8, 1978

[54] MOTOR GRADER BLADE SUPPORT WITH SELF-RETAINING WEAR STRIPS

[75] Inventor: Russell L. Gilbert, Kingsland, Tex.

[73] Assignee: Caterpillar Tractor Co., Peoria, Ill.

[21] Appl. No.: 746,569

[22] Filed: Dec. 1, 1976

[51] Int. Cl.[2] ..... E02F 3/76

[52] U.S. Cl. ..... 172/781; 172/741; 403/364

[58] Field of Search ..... 172/305, 476, 667, 673, 172/719, 741, 743, 781, 789, 791, 792, 793, 795, 796, 797; 403/110, 364; 428/121, 124; 16/170; 248/220.1, 300

[56] References Cited

U.S. PATENT DOCUMENTS

| | | | |
|---|---|---|---|
| 2,799,099 | 7/1957 | Leliter | 172/667 |
| 3,444,936 | 5/1969 | Page et al. | 172/795 |
| 3,463,243 | 8/1969 | Fisher | 172/781 |
| 3,465,829 | 9/1969 | Fisher et al. | 172/743 |
| 3,741,428 | 6/1973 | Evjen et al. | 248/300 X |
| 3,858,837 | 1/1975 | Merritt | 248/300 |
| 3,983,945 | 10/1976 | Hart et al. | 172/795 |

FOREIGN PATENT DOCUMENTS

| | | | |
|---|---|---|---|
| 121,430 | 5/1946 | Australia | 248/300 |

*Primary Examiner*—Richard T. Stouffer
*Attorney, Agent, or Firm*—Phillips, Moore, Weissenberger, Lempio & Majestic

[57] ABSTRACT

Structure for fastening the blade of a motor grader to a support carried on the vehicle while enabling sideward sliding movement of the blade includes support brackets each of which has a slot for receiving a slide rail that is secured along the back of the blade. To sustain wear and to facilitate compensating adjustments for such wear, a pair of replaceable wear strips are situated in each slot between the bracket and rail. The two wear strips are locked together by interleaved portions and each has an angled end portion abutting a separate side surface of the bracket. This construction locks the wear strips in place without requiring any additional fastening means to prevent wear strip movement out of the slots during sliding movement of the blade and rails. The pair of wear strips may have similar configurations enabling interchanging of the two strips after a period of time to distribute wear more evenly. Using wear strips of a single shape also simplifies the stocking of replacement parts and forestalls improper installation.

14 Claims, 6 Drawing Figures

MOTOR GRADER BLADE SUPPORT WITH SELF-RETAINING WEAR STRIPS

BACKGROUND OF THE INVENTION

This invention relates to graders of the type used in earth-working and road-building operations and more particularly to structures for coupling the blade or moldboard of a grader to the vehicle while enabling sideward movement of the blade relative to the blade supports.

The blade or moldboard of a grader is usually coupled to the vehicle through a complex mounting assembly designed to enable the blade to be manipulated and oriented in several different ways relative to the path of travel of the vehicle. One of the blade motions which is usually provided for is a sideward or lateral movement relative to the structure which supports the blade. In order to provide for this sideward movement, it is customary to secure a pair of linear slide rails along the back of the blade. Support brackets carried below the blade circle of the grader have slots into which the slide rails are received. Thus the blade is effectively fastened to the vehicle and carried thereon but may be moved sidewardly by a sliding movement of the rails in the support brackets. Hydraulic actuators or the like are usually present to facilitate the sideward adjustment of the position of the blade in operation.

To prevent wearing of the slot surfaces of the brackets by movement of the rails, many grader constructions utilize some form of wear strips or slide bearings within the bracket slots. Unlike the brackets, which are permanent parts of the vehicle and which are relatively costly, such wear strips can be replaced from time to time when wearing has progressed to the point that the blade is too loosely mounted to enable the desired degree of precision in grading operations. Some blade mounting structures provide for a limited amount of shimming to compensate for wear or for compensation by threaded adjustments which act on the slide bearings but as a practical matter occasional replacement of the wear strips is required. The strong reaction forces which may bear against the blade of a grader in use and the fact that highly abrasive sand or rock particles may often be present in the region of the slide rails contribute to the severity of the wear problem.

Although a variety of wear strips or slide bearings have been developed for this particular purpose, the prior structures exhibit one or more characteristics which it would be desirable to avoid. First, adjustment of the lateral position of the blade and rails may exert strong sideward forces tending to pull the wear strips out of the support bracket slots. To prevent this it has heretofore been necessary to complicate the support structure by providing removable wear strip retainer elements at each side of the brackets to hold the wear strips in place, such fastening means usually being secured in place by bolts or the like. Sideward forces are sufficiently severe that occasional failure of these bolts has been encountered.

In most constructions, a pair of wear strips are required within each bracket and heretofore the two members of each pair have required different configurations. This prevents interchanging of the two wear strips when the wear on one is more pronounced than the wear on the other as is often the case. This has the undesirable effect of shortening the period between replacements. The requirement for two different wear strip configurations may also create a possibility of incorrect orientation during installation and complicates the manufacture and stocking of replacement parts.

Still further, installation of prior wear strip replacements in the field has inherently been a somewhat difficult task, in many cases requiring complete removal of the blade from the grader.

SUMMARY OF THE INVENTION

This invention provides a blade support structure for a motor grader or the like in which the paired wear strips at each bracket interlock with each other and with the associated bracket to prevent lateral displacement during side-shifting of the blade. No separate fastening or retainer means are needed to hold the wear strips in place against sideward movements. In a preferred form, both of the paired wear strips may have an identical configuration thereby enabling interchanging to distribute wear evenly over a period of time. Use of the single wear strip configuration also prevents improper reversed installation and simplifies the manufacture and stocking of replacement parts.

The wear strips each have an angled end portion. When paired and installed in a bracket with one wear strip reversed end to end relative to the other, the end portion of one wear strip abuts one side of the bracket to block movement in one direction while the end portion of the other bracket abuts the opposite side of the bracket to block movement in an opposite direction. The paired wear strips also have interleaved portions which block sideward movement of each strip independently of the other. Thus sideward movement of either wear strip in either direction along the associated support bracket slot is normally blocked without requiring any supplementary fastening means for such purpose.

Accordingly, it is an object of this invention to provide simpler and more efficient wear strip arrangements in mounting structures for attaching a blade to a motor grader.

The invention, together with further objects and advantages thereof, will best be understood by reference to the following description of a preferred embodiment taken in conjunction with the accompanying drawings.

DESCRIPTION OF A PREFERRED EMBODIMENT

Figure 1:
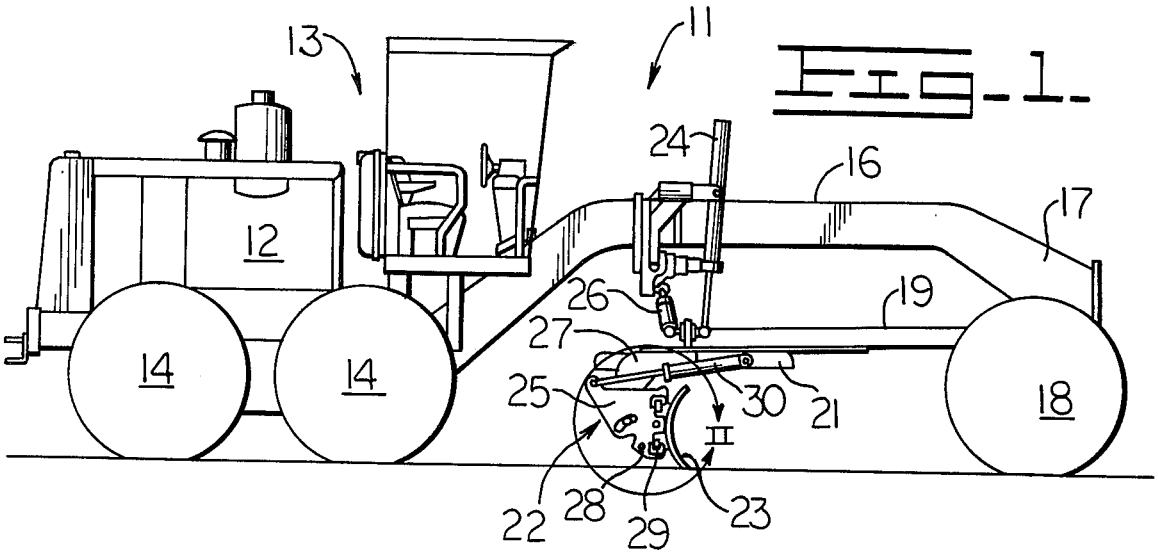
FIG. 1 is a side elevation view of a motor grader utilizing the present invention for supporting an earth-working blade.

Referring initially to FIG. 1 of the drawing, a motor grader 11 may typically have an engine 12 and an operator station 13 supported on rear wheels 14. An arched main frame member 16 extends forward from the operator station to a bolster 17 riding on front wheels 18. A pivotable drawbar 19 extends rearwardly from bolster 17 to support a blade circle 21 which in turn supports a mounting structure 22 to which the moldboard or blade 23 is coupled. Hydraulic lift cylinders 24 are connected between the main frame member 16 and each side of drawbar 19 to provide for raising and lowering of the blade 23 and also to provide for changing the slope of the blade by differential operation of the lift cylinders. Adjustable linkage 26 extending laterally from the main frame 16 to the back of the drawbar 19 provides for lateral positioning or side-shifting of the blade 23 including the blade circle and blade-mounting structure 22 carried on the back of the drawbar. Mounting structure 22 is coupled to arms 27, which extend downward from blade circle 21, through a horizontal pivot coupling 28 to enable control of the tilt of the blade 23 through hydraulic jacks 30 which are connected between the mounting structure plates 25 and the blade circle. The blade circle 21 is itself rotatable to provide for angling of the blade 23 relative to the direction of travel.

The structure of the motor grader 11 as reviewed up to this point may be conventional and thus suitable details for the several mechanisms briefly identified above, other than mounting structure 22, are known to the art. It should be understood that the particular form of motor grader 11 depicted in FIG. 1 for purposes of example is only one of many different forms of grader vehicle on which the present invention may be utilized.

While the particular motor grader 11 described above includes conventional side-shifting linkage 26 that enables a limited degree of lateral adjustment of the position of the blade 23, use of this means alone may not provide the desired amount of flexibility with respect to lateral positioning of the blade 23. The motion provided by side-shifting linkage 26 is, if unaccompanied by other adjustments, an arcuate pivoting movement which changes the angling and tilt of the blade as well as the lateral position of the blade. To provide for a supplementary and strictly linear sideward movement which does not otherwise affect blade orientation, it is customary to attach the blade 23 to the supporting structure such as mounting structure 22 through slide rails 29 that enable the blade to be moved laterally relative to the mounting structure as might be desired.

Figure 2:
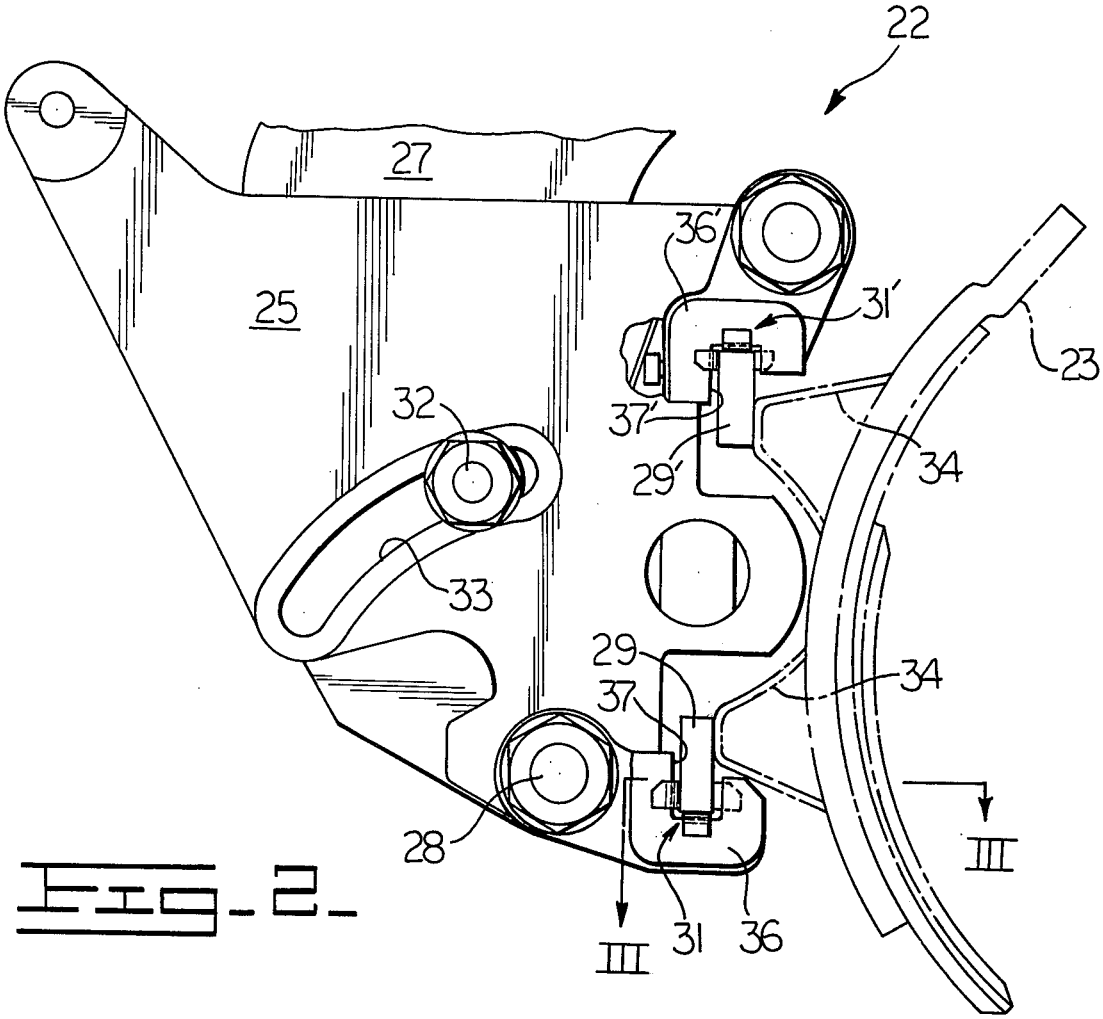
FIG. 2 is an enlarged view of the portion of FIG. 1 encircled by line II thereof better illustrating the blade mounting structure.
Figure 3:
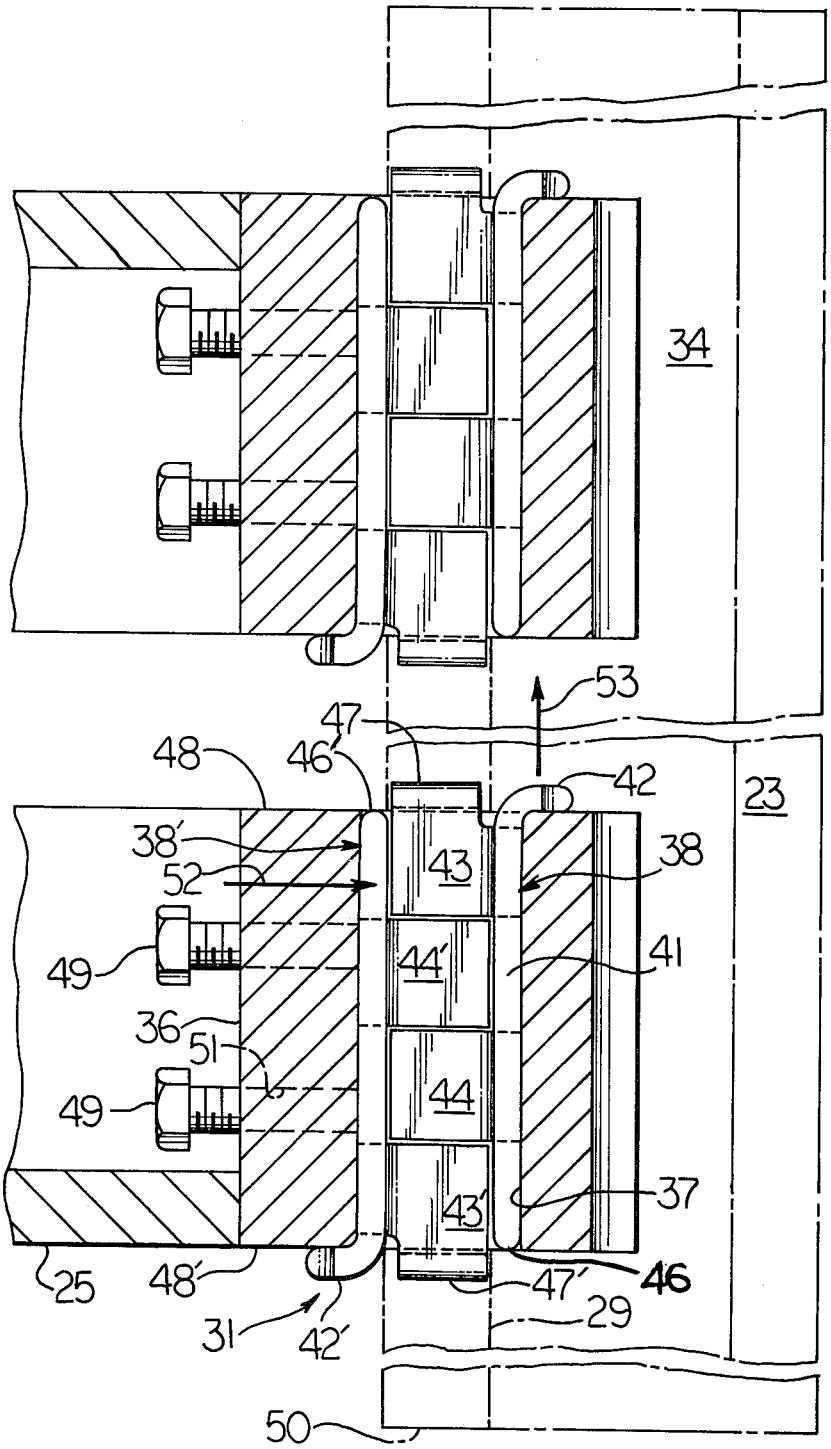
FIG. 3 is a foreshortened plan section view taken along line III—III of FIG. 2.

The frequent presence of sand, gravel or other abrasive material around the blade 23, together with the fact that strong reaction forces are often acting against the blade at times when it is moved in the sideward direction, cause severe wearing to occur within the portions of the mounting structure that contact the slide rails 29. As this cannot be easily avoided, replaceable wear strips or slide bearings of one form or another are usually provided to absorb the brunt of such wear. Referring now to FIGS. 2 and 3 in conjunction, the mounting structure 22 of the present invention includes wear strip assemblies 31 and 31′ of novel configuration and disposition which, relative to the prior art, realize the several advantages hereinbefore discussed.

Considering the mounting structure 22 in greater detail, each of the pair of plates 25 is coupled to a separate one of the support arms 27 through a pivot connection formed by pivot coupling 28. A bolt 32 may extend from arm 27 through an arcuate slot 33 in plate 25 to further support the plates 25 without interfering with pivoting movement about pivot coupling 28 and to define limits for such pivoting movement.

The blade 23 is situated forwardly from plates 25 and a pair of linear slide rails 29 and 29′ extend along the back of the blade in parallel relationship to the blade, rail 29 being lowermost and rail 29′ being uppermost. Rails 29 are fastened by welding or other means to transverse support members 34 which are in turn secured to the back of the blade 23, the attachment between lower rail 29 and the associated transverse member 34 being confined to the upper portion of rail 29 while the weld between upper rail 29′ and the associated transverse member 34 is confined to the lower portion of the upper rail.

Each plate 25 has a pair of rail-receiving brackets, including a lower bracket 36 and an upper bracket 36′ secured to the forward edge. Lower bracket 36 has a transverse slot 37 which is open at the upper end to receive the lower portion of the lower rail 29 while upper bracket 36′ has a transverse slot 37′ which is open at the lower end to receive the upper portion of the upper rail 29′. Slots 37 and 37′ are proportioned to receive the lower and upper wear strip assemblies 31 and 31′ between the brackets 36 and 36′ and rails 29 and 29′ to prevent wearing of the brackets which are permanent parts of the mounting structure.

Figure 5:
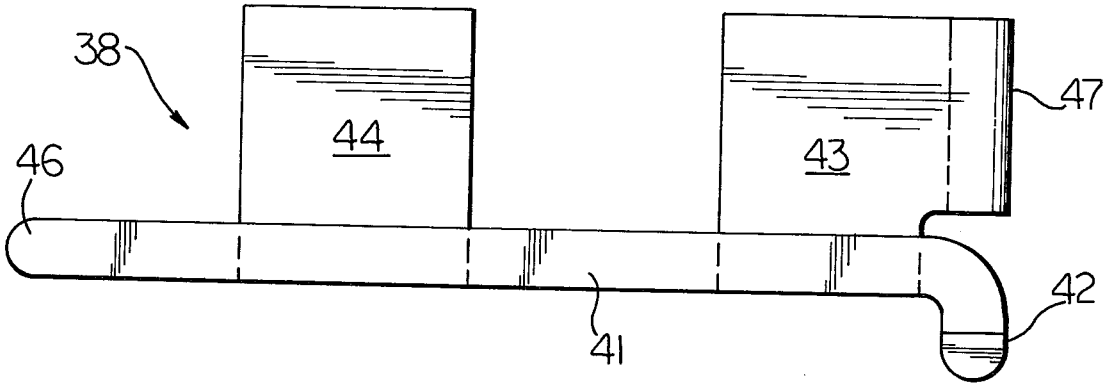
FIG. 5 is a top view of the wear strip member of FIG. 4.
Figure 6:
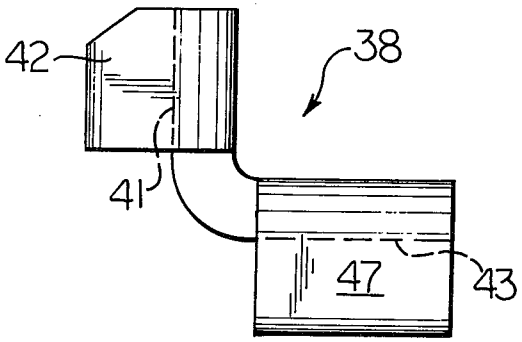
FIG. 6 is an end view of the wear strip member of FIGS. 4 and 5.
Figure 4:
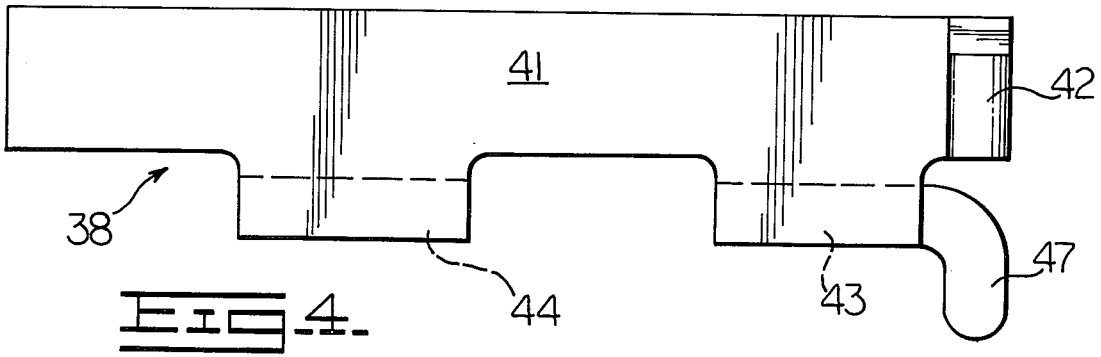
FIG. 4 is an elevation view of a wear strip member employed in the blade-mounting structure of the preceding figures and showing the wear strip member separated from the other components of the mounting structure.

Each wear strip assembly 31 and 31′ includes a pair of interleaving wear strip members 38 and 38′ which, as best seen in FIG. 3, may be of identical configuration but which are oppositely oriented within the slot 37. A suitable configuration for the wear strip members 38 and 38′ is best seen in FIGS. 4, 5 and 6 in conjunction wherein a single wear strip member 38 is shown separated from the other mounting structure.

In particular, the wear strip member 38, which may be formed as a single integral element, has a first portion 41 of rectangular configuration for fitting against one side of the slot in which it is to be disposed as previously described. A relatively short retainer portion 42 of the wear strip member 38 situated at one end of portion 41 extends at right angles to portion 41 in order to block longitudinal movement of the wear strip in one direction as will hereinafter be described.

To provide for interleaving of parts of a pair of the wear strip members 38 whereby each blocks longitudinal movement of the other when installed in the previously described bracket, one or more tab portions, of which there are two tab portions 43 and 44 in this example, extend from portion 41 at right angles to the plane of portion 41. Tab portion 43 is situated at the end of portion 41 which also carries retainer portion 42 while tab 44 is situated at an intermediate section of portion 41 in spaced relationship from both tab 43 and the other end 46 of portion 41. An end 47 of tab 43 is turned at right angles to the rest of the tab to be coplanar with retainer portion 42. The spacing between tab portions 43 and 44 is substantially the same as the width of tab portion 44 as measured along portion 41 while the spacing of tab portion 44 from end 46 is substantially the same as the width of the tab portion 43 excluding the angled end 47 of tab portion 43.

The above-described wear strip member configuration enables one such wear strip member 38' to be turned end-to-end relative to the other wear strip 38 for installation in the slot 37 of mounting bracket 36 as best seen in FIG. 3. When installed in this manner the end retainer portions 42 and 47 of one such wear strip member 38 abut against one surface 48 of mounting brackets 36 while the corresponding retainer portions of the other wear strip 38' abut against the opposite end surface 48' of the bracket. Thus wear strip member 38 is prevented from moving in the direction of surface 48' of the bracket 36 while wear strip member 38' is prevented from moving in the direction of the opposite surface 48 of the bracket. When installed in the slot 37 in this manner tab portion 44 of wear strip member 38 occupies the space between tab portions 43' and 44' of the other wear strip member 38' while tab portion 43 of the wear strip member 38 occupies the space between tab portion 44 and end 46 of the other wear strip member 38'. This interleaving of the two wear strip members 38 and 38' prevents any independent movement of one wear strip member relative to the other along slot 37. Since neither wear strip member 38 or 38' can move independently and since wear strip member 38 is prevented from moving in one direction by the retainer portions 42 and 47 of that wear strip member while the other wear strip member 38' is similarly prevented from moving in the opposite direction, the wear strip assembly 31 as a whole is locked into place as far as longitudinal movement in slot 37 is concerned. Forces generated by the moving slide rail 29 are ineffective to eject the wear strips from the slot notwithstanding the fact that no separate retaining means are present.

It should be observed that the above-described constraint against longitudinal movement of the wear strips within slot 37 does not prevent some relative forward and backward adjustment in a direction normal to the slot in order to compensate for wear when the fitting of the slide rail 29 into the slot becomes loose. Shims may be employed in the conventional manner for this purpose or adjustment screws 49 may be engaged in threaded bores 51 in the back arm of the bracket 36 to act against the adjacent wear strip member 38' in order to urge it toward the more forward wear strip member 38 as necessary to compensate for wear.

When, owing to excessive wearing, replacement of the wear strips becomes necessary this can be accomplished without removing the blade from the motor grader. Referring still to FIG. 3, if the blade is slid to one side, beyond the normal range of such movement during operation, to the point where the end 50 of side rail 29 is situated over only the tab portion 43 of wear strip member 38, that is to the position designated by arrow 52 in FIG. 3, then that end 50 of the blade is still being supported by the bracket 36 but the rail no longer overlies either of the tab portions 43 and 44 of the other wear strip member 38'. Wear strip member 38' may then simply be lifted out of slot 37 and be removed. It is then easily possible to temporarily lift the blade slightly with pry bars, jacks or other means sufficiently to take the load off the tab portion 43 of the remaining wear strip member 38. Wear strip member 38 may then readily be removed by withdrawing retainer portions 42 and 47 away from bracket end surface 48 in the direction indicated by arrow 53. Installation of a new pair of the wear strip members 38 and 38' is then readily accomplished by reversing this procedure.

While the wear strip construction has been described primarily with reference to the one of the wear strip assemblies 31 which is located at the lower right corner of the mounting structure 22 of the motor grader depicted in FIGS. 1 and 2, the other wear strip assemblies may have a similar configuration except insofar as the uppermost wear strip assemblies 31' are inverted to accommodate to the inverted disposition of the mounting brackets 36' for the upper slide rail 29'.

Referring again to FIG. 3, it may be observed that the desired self-locking of the wear strip members 38 and 38' into the groove 37 may be achieved if the wear strip members have only the innermost ones 44 of the two tab portions 43 and 44 used in the present example. In such a construction the tab 44 of each wear strip member could, if desired, be longer in order to extend along the space occupied by the adjacent tab portions 43 of the other wear strip member in this particular example. Similarly, it will be evident that the wear strip members 38 could be constructed with more than the two tab portions present on each wear strip member in this particular example. The basic criterion is that the wear strip have at least one angled retainer portion on one end for blocking motion in one direction in the bracket slot and that it have at least one tab portion positioned to abut the corresponding tab portion of a similar but reversed wear strip member.

Thus while the invention has been described with reference to a specific preferred embodiment, it will be apparent that many variations and modifications are possible and it is not intended to limit the invention except as defined in the following claims.

What is claimed is:

1. Mounting structure for attaching a blade to a grader wherein said blade has a linear slide rail secured thereto which is engaged by said mounting structure to enable sideward sliding movement of the blade relative to the mounting structure, comprising:

a bracket forming a part of said mounting structure and having opposite outwardly facing side surfaces facing away from each other and connected by a slot for receiving an edge portion of said rail, a pair of self-retaining wear strip members disposed in said slot of said bracket, each of said wear strip members having a main body extending along said slot and further having as a fixed component element thereon a retainer portion at one end only which is angled away from said main body and said slot to extend along and abut a separate one of said opposite outwardly facing side surfaces of said bracket than that abutted by the retainer portion of the other wear strip thereby blocking movement of a first of said wear strip members along said slot in one direction and blocking movement of the second of said wear strip members in the opposite direction, said wear strip members further having abutted portions which block independent movement along said slot of one wear strip member relative to the other thereby causing said wear strips jointly to be blocked from longitudinal movement in either direction along said slot.

2. Mounting structure as defined in claim 1 wherein said wear strip members have a substantially identical configuration with said second wear strip member being disposed in said slot in a reversed end-to-end orientation relative to said first wear strip member.

3. Mounting structure as defined in claim 1 wherein said wear strip members including said angled retainer portions thereof are each a single integral element.

4. Mounting structure as defined in claim 1 wherein said main body of each of said wear strip members has a flat rectangular first portion abutted against a wall of said slot and has at least one tab portion extending at right angles to said first portion towards the opposite wall of said slot, said tab portions of each of said wear strip members being abutted against each other to cause said angled retainer portion of each of said wear strip members to block movement of the other of said wear strip members along said slot.

5. Mounting structure as defined in claim 4 wherein said tab portion is rectangular and situated at the end of said first portion from which said angled retainer portion extends.

6. Mounting structure as defined in claim 5 wherein said tab portion has an end extending at right angles to the remainder of said tab portion and at right angles to said first portion and which is coplanar with said retainer portion to form a supplementary retainer portion.

7. Mounting structure as defined in claim 1 wherein said main body of each of said wear strip members has a rectangular first portion angled at one end to form said retainer portion and further has spaced-apart first and second tab portions extending at right angles to said first portion, said first tab portion being adjacent said one end and remote from the opposite end and said second tab portion being situated at an intermediate section of said first portion between said first tab portion and said opposite end.

8. A grader blade slide rail bearing wear strip for disposition between a grader blade slide rail and a supporting bracket therefor, jointly with another similar but reversed wear strip, comprising an integral element having a flat substantially rectangular parallelepipedol first portion and a retainer portion at one end only of said first portion, said one end facing in a first direction, said retainer portion extending away from said first portion at right angles to the longitudinal extent of said first portion in order to be abutable against an outwardly facing side surface of said supporting bracket, said wear strip further having at least one tab portion extending away from said first portion in an opposite direction relative to said retainer portion and at right angles to the longitudinal extent of said first portion and which includes a major face at right angles to the surface of said retainer portion which faces in said first direction said tab portion having a length less than that of said first portion in order to be capable of interleaving with said tab portion of said other similar but reversed wear strip.

9. A wear strip as defined in claim 8 wherein said one tab portion is situated on said first portion adjacent said one end thereof, and wherein said wear strip has a second tab portion extending from said edge in coplanar spaced-apart relationship to said one tab portion, said one tab and said second tab being spaced apart a distance corresponding to the length of said second tab as measured along said edge of said first portion, said second tab being spaced apart from the opposite end of said first portion a distance corresponding to the length of said one tab as measured along said edge.

10. A wear strip as defined in claim 8 wherein said one tab has a right-angled end portion extending in coplanar relationship with said retainer portion.

11. Mounting structure for a slidable element wherein said slidable element has a linear slide rail secured thereto which is engaged by said mounting structure to enable sliding movement of the slidable element relative to the mounting structure, comprising:

a bracket forming a part of said mounting structure and having opposite outwardly facing side surfaces facing away from each other connected by a slot for receiving an edge portion of said rail, a pair of self-retaining wear strip members disposed in said slot of said bracket, each of said wear strip members having a main body extending along said slot and further having as a fixed component element thereon a retainer portion at one end only which is angled away from said main body and said slot to extend along and abut a separate one of said opposite outwardly facing side surfaces of said bracket than that abutted by the retainer portion of the other wear strip thereby blocking movement of a first of said wear strip members along said slot in one direction and blocking movement of the second of said wear strip members in the opposite direction, said wear strip members further having abutted portions which block independent movement along said slot of one wear strip member relative to the other thereby causing said wear strips jointly to be blocked from longitudinal movement in either direction along said slot.

12. Mounting structure as defined in claim 11 wherein said wear strip members have a substantially identical configuration with said second wear strip member being disposed in said slot in a reversed end-to-end orientation relative to said first wear strip member.

13. Mounting structure as defined in claim 11 wherein said main body of each of said wear strip members has a flat rectangular first portion abutted against a wall of said slot and has at least one tab portion extending at right angles to said first portion towards the opposite wall of said slot, said tab portions of each of said wear strip members being abutted against each other to cause said angled retainer portion of each of said wear strip members to block movement of the other of said wear strip members along said slot.

14. Mounting structure as defined in claim 11 wherein said main body of each of said wear strip members has a rectangular first portion angled at one end to form said retainer portion and further has spaced-apart first and second tab portions extending at right angles to said first portion, said first tab portion being adjacent said one end and remote from the opposite end and said second tab portion being situated at an intermediate section of said first portion between said first tab portion and said opposite end.

* * * * *